US007902761B2

(12) United States Patent
Ang et al.

(10) Patent No.: US 7,902,761 B2
(45) Date of Patent: Mar. 8, 2011

(54) DIMMABLE LED LAMP

(75) Inventors: Simon Saw-Teong Ang, Fayetteville, AR (US); Jeffrey Alan Beaver, Fayetteville, AR (US)

(73) Assignee: Next Gen Illumination, Inc, Fayetteville, AR (US)

( * ) Notice: Subject to any disclaimer, the term of this patent is extended or adjusted under 35 U.S.C. 154(b) by 371 days.

(21) Appl. No.: 12/244,860

(22) Filed: Oct. 3, 2008

(65) Prior Publication Data

US 2010/0084990 A1 Apr. 8, 2010

(51) Int. Cl.
*G05F 1/00* (2006.01)

(52) U.S. Cl. ..... 315/194; 315/224; 315/209 R; 315/291; 315/DIG. 4

(58) Field of Classification Search ..... 315/224, 315/225, 247, 246, 209 R, 291, 307, DIG. 4, 315/185 S, 194
See application file for complete search history.

(56) References Cited

U.S. PATENT DOCUMENTS 4,729,076 A 3/1988 Masami et al.
4,780,799 A 10/1988 Groh
4,841,422 A 6/1989 Groh
5,173,839 A 12/1992 Metz
5,575,459 A 11/1996 Anderson
5,688,042 A 11/1997 Madadi et al.
5,785,418 A 7/1998 Hochstein
5,850,126 A 12/1998 Kanbar
D423,502 S 4/2000 Lanclos
6,220,722 B1 4/2001 Begemann
6,227,679 B1 5/2001 Zhang et al.
6,234,645 B1 5/2001 Borner et al.
6,234,648 B1 5/2001 Borner
6,307,316 B1 10/2001 Holzer
6,375,340 B1 4/2002 Biebl et al.
6,481,874 B2 11/2002 Petroski
6,517,218 B2 2/2003 Hochstein
6,634,771 B2 10/2003 Cao
6,639,356 B2 10/2003 Chin
6,659,632 B2 12/2003 Chen
D487,939 S 3/2004 Smith
6,709,132 B2 3/2004 Ishibashi
6,793,374 B2 9/2004 Begemann
D498,310 S 11/2004 Gagnon et al.
6,864,513 B2 3/2005 Lin et al.
6,949,772 B2 9/2005 Shimizu et al.
D513,640 S 1/2006 Chen
6,982,518 B2 1/2006 Chou et al.
D514,715 S 2/2006 Chen
D516,229 S 2/2006 Tang
D527,119 S 8/2006 Maxik et al.
7,086,767 B2 8/2006 Sidwell et al.
D528,227 S 9/2006 Chou et al.
D528,673 S 9/2006 Maxik et al.
7,144,135 B2 12/2006 Martin et al.
7,198,386 B2 4/2007 Zampini et al.
7,204,615 B2 4/2007 Arik et al.
D541,957 S 5/2007 Wang
D542,425 S 5/2007 Wang
D542,943 S 5/2007 Wang
D547,466 S 7/2007 Lo
D549,854 S 8/2007 Takahashi
7,255,460 B2 8/2007 Lee
7,325,949 B1 2/2008 Wang (Continued)

*Primary Examiner* — Tuyet Thi Vo
(74) *Attorney, Agent, or Firm* — Mark M. Henry

(57) ABSTRACT

An LED lamp utilizes AC power and bi-directional LED chips to provide dimming capabilities. The dimming capabilities of the lamp reduce the junction temperature of the LEDs on the bi-directional LED chips and thus prolong the life expectancy of the LED lamp.

4 Claims, 7 Drawing Sheets

U.S. PATENT DOCUMENTS

| | | | |
|---|---|---|---|
| 7,329,030 | B1 | 2/2008 | Wang |
| 7,358,679 | B2 | 4/2008 | Lys et al. |
| 2005/0036328 | A1 | 2/2005 | Walser et al. |
| 2006/0098440 | A1 | 5/2006 | Allen |
| 2006/0193130 | A1 | 8/2006 | Ishibashi |
| 2006/0255359 | A1 | 11/2006 | Sun et al. |
| 2006/0274529 | A1 | 12/2006 | Cao |
| 2007/0236912 | A1 | 10/2007 | Porchia et al. |
| 2007/0253188 | A1 | 11/2007 | Klipstein et al. |
| 2007/0285926 | A1 | 12/2007 | Maxik |
| 2007/0297178 | A1 | 12/2007 | Tain et al. |
| 2008/0013316 | A1 | 1/2008 | Chiang |

DIMMABLE LED LAMP

GOVERNMENTAL RIGHTS

None.

CROSS REFERENCES

None.

BACKGROUND OF THE INVENTION

The invention relates to the field of light-emitting diode ("LED") lamps, specifically LED lamps capable of being dimmed to reduce energy usage and prolong the life of the lamp.

Lamps of all kinds, whether incandescent, halogen, sodium vapor, or LED, produce heat as a byproduct of the electrical production of light. The hotter the lamp temperature becomes the shorter the life of the lamp. Lamps are typically designed to provide a designed life at a specified voltage and amperage. For instance, a typical incandescent bulb powered with 110 volts of AC power that draws 25 to 110 W has a typical life expectancy of 2,000 hours. If the voltage applied to an incandescent lamp's filament is reduced by 5%, the life of the bulb is doubled and the light output is reduced by approximately 20%. Thus, it is known in the art that dimming a lamp results in prolonged life.

Energy prices have generally risen above the rate of inflation since the 1970's, and energy efficiency has become increasingly important in the global economy. Lamps of all kinds are subject to increasing energy efficiency standards, and the United States has passed laws phasing out inefficient incandescent bulbs by 2014.

LED lamps represent one type of lighting technology vying to replace incandescent bulbs on the market. Typical LED lamps have several LEDs mounted in series to a circuit board. LEDs are semiconductors in which the current flows in only one direction; that is, typical LED lamps require DC current for proper operation. For years, this property led to a limitation on AC-powered LEDs in which an AC-DC converter was required as part of the LED lamp. Such a converter is inherently inefficient, as it serves as an additional source of heat and requires space not available in many lamp applications. Thus, it is an object of the invention to provide a dimmable LED lamp that utilizes AC power without requiring a separate AC-DC converter.

U.S. Pat. No. 7,417,259 (the "'259 patent") discloses an LED lamp that natively runs on AC power. To achieve this, the '259 patent discloses two sets of LEDs wired in series, with each set having an opposite polarity. Thus, when alternating current is applied to the circuit, one set of LEDs is alternatively lit at any given time. The '259 patent thus provides an LED lamp that runs on AC power without the necessity of an AC-DC converter; however, the LED lamp disclosed in the '259 patent is not capable of being dimmed without flickering due to the inherent instability of AC current. That is, in virtually all applications, it is well known that AC power supplied by the public grid will fluctuate in both voltage and frequency, yet the '259 patent does not account for such fluctuations. It is thus an object of the invention to provide an AC-powered LED lamp that is also capable of being dimmed by various dimming circuit means.

Dimming devices are well known in the art. For example, U.S. Pat. No. 794,983 (the "'983 patent") discloses a rheostat, which is a device used to vary the resistance in a circuit, thus varying the voltage available to the rest of the circuit. Rheostats are capable of dimming incandescent bulbs by reducing the voltage across the filament of the incandescent bulb. While rheostats are well suited to dimming an incandescent bulb, rheostats are not as efficient as some would believe because rheostats do not actually reduce the power used by the circuit; rather, the power is converted to heat by the rheostat. Thus, the energy is not converted to light by the incandescent bulb filament. It is an object of the invention to provide a dimmable LED lamp in which the actual circuit power consumption is reduced when the LED lamp is dimmed by a user.

Traditional rheostats are standard dimming devices used in the lighting industry, making them commercially viable for retrofit uses of AC-powered LED lamps. However, no prior art solves the problem of flickering when using a rheostat with an AC-powered LED lamp. To illustrate, while incandescent bulb filaments produce both heat and light proportional to the voltage applied across such filaments, LEDs require a minimum "on voltage" to be operable. The on voltage for an LED depends on the current applied and the type of semiconducting material from which the LED is made, but the on voltage is always significant. Due to this limitation, AC voltage waves for LEDs are said to be "square waveforms," whereas AC voltage waves for incandescent bulbs are more typically sinusoidal waveforms. Thus, instead of having three points in time at which the voltage is zero as in a sine wave, a square wave for an LED has three much longer discrete blocks of time during which the voltage is zero. When a rheostat is connected to an LED lamp, the square wave defined by the on voltage creates an unwanted visible flicker. It is thus an object of the invention to provide an AC-powered LED lamp that does not have such a visible flicker.

Other dimming devices standard in the industry include silicon-controlled rectifiers ("SCRs") and triodes for alternating current ("TRIACs"). When these types of semiconducting dimmers are used to dim an AC-powered LED lamp, the phase-controlled sinusoidal voltage waveform nonetheless results in a visible flicker and other unwanted harmonics. It is thus an object of the invention to provide an AC-powered LED lamp that does not have a visible flicker, regardless of the dimming circuitry used. It is a further object of the invention to provide an AC LED lamp capable of being connected to a rheostat, SCR dimmer, TRIAC dimmer, or other dimmer known in the prior art, thus achieving the goals of power savings and reduction of heat, even in retrofit applications.

BRIEF SUMMARY OF THE INVENTION

The invention solves the problems of the prior art by providing an LED lamp that is capable of being dimmed. The LED lamp has one or more bi-directional LED chips that can be powered with AC power. Each bi-directional chip is enclosed within resistors of substantially equal resistance in order to ensure the voltage applied across each bi-directional LED chip is approximately equal. A varistor shields the bi-directional LED chips from voltage spikes that could damage the bi-directional LED chips. An LC filter removes high-frequency voltage spikes to protect the bi-directional LED chips, thus reducing flicker and increasing light output for a predetermined voltage. A dimmer is connected to the AC power source to preferentially regulate voltage available to the remainder of the circuit. The invention is compatible with dimmers of the prior art, including rheostats, SCR dimmers, DIAC and TRIAC dimmers, and other dimmers known to persons having ordinary skill in the art.

The advantages of the invention include providing extended life to LED lamps by reducing the junction temperature of the LEDs integrated within the bi-directional LED chips; the inventors have realized nearly double the life expectancy at half the illumination output by reducing the junction temperature by approximately twenty percent (20%).

These and other advantages provided by the invention will become apparent from the following detailed description which, when viewed in light of the accompanying drawings, disclose the embodiments of the invention.

LISTING OF COMPONENTS

101—AC-powered LED lamp
103—bi-directional LED chip
105—AC power source
107—varistor
109—resistors
111—rheostat
113—light-emitting diodes ("LEDs")
115—electrodes
117—n-LED block
119—semiconductor-controlled rectifier ("SCR") dimmer
121—SCR gate
123—variable resistor
125—capacitor
127—Darlington transistor
129—NPN transistor
131—PNP transistor
133—LC filter
135—dimmer

DETAILED DESCRIPTION OF THE INVENTION

Figure 1:
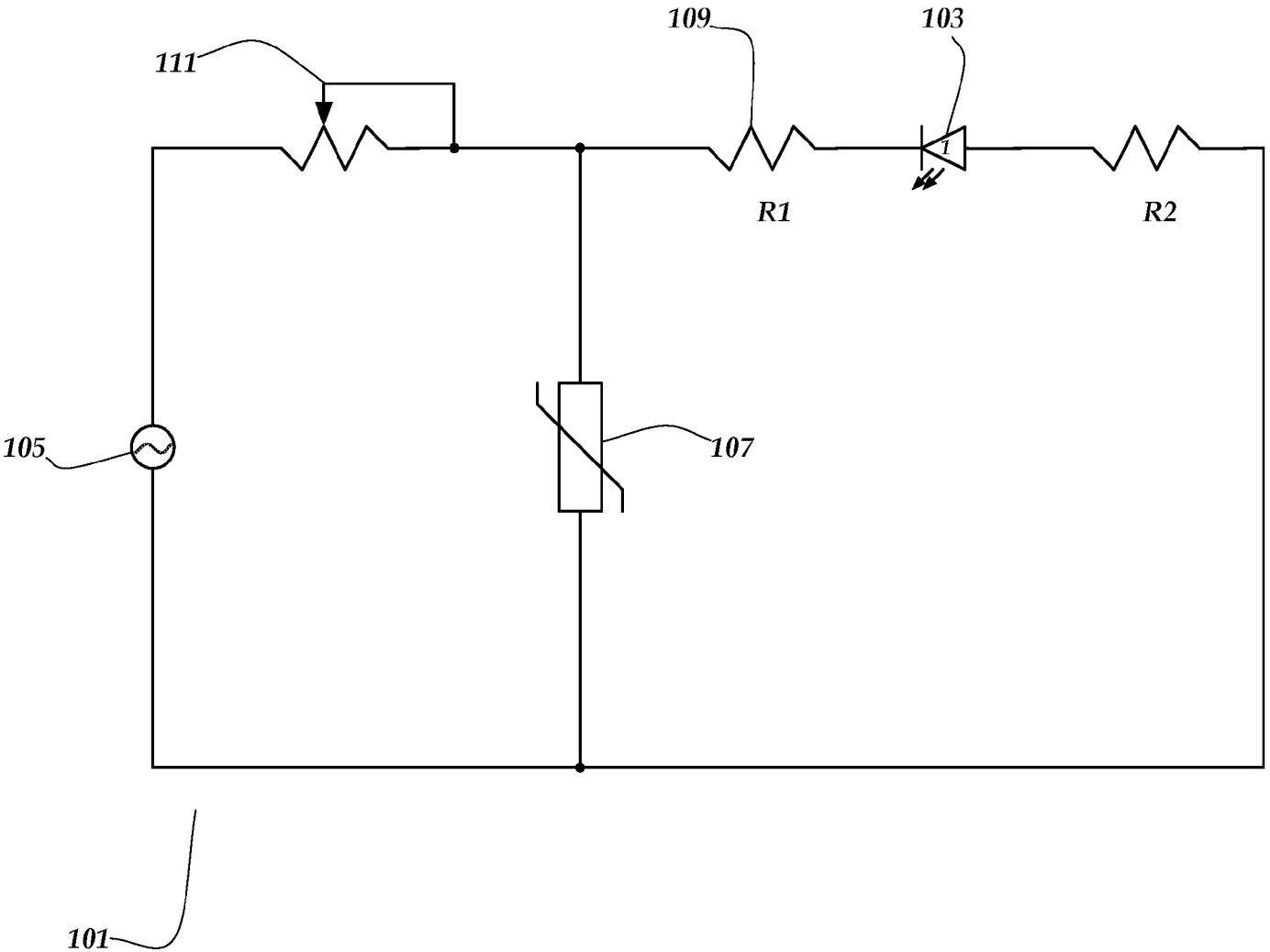
FIG. 1 is a circuit diagram showing an implementation of the invention having a power source, load, rheostat, and surge protection.

The invention as disclosed herein provides a virtually flicker-free, AC-powered LED lamp capable of being preferentially dimmed. As seen in FIG. 1, AC-powered LED lamp 101 comprises a circuit in which one or more bi-directional LED chips 103 are connected to AC power source 105. Bi-directional LED chip 103 is a typical AC-powered LED binary chip designed to be either switched off or supplied with full power from a power grid, such as 110V AC or 220V AC. One bi-directional LED chip is manufactured by Seoul Semiconductor under the trade name Acriche. A varistor 107 is placed in parallel to bi-directional LED chip 103 in order to shunt excess current due to voltage spikes from AC power source 105. Resistors 109 having substantially equivalent resistance are connected to either side of each bi-directional LED chip 103 in order to apply the proper predetermined amount of voltage across each bi-directional LED chip 103. A rheostat 111 may be added in series with AC power source 105 in order to control the voltage applied to bi-directional LED chips 103. In such configuration, rheostat 111 provides dimming functionality to AC-powered LED lamp 101. Such configuration provides backwards compatibility with rheostats of the prior art.

Resistors 109 and varistor 107 provide the basic functionality to AC-powered LED lamp 101. Without resistors 109, voltage levels may vary across bi-directional LED chip 103, leading to chip damage, particularly when more than one bi-directional LED chip 103 is used. Likewise, without varistor 107, voltage levels may spike across bi-directional LED chip 103 (even when resistors 109 are present), thus damaging bi-directional LED chip 103.

Figure 2:
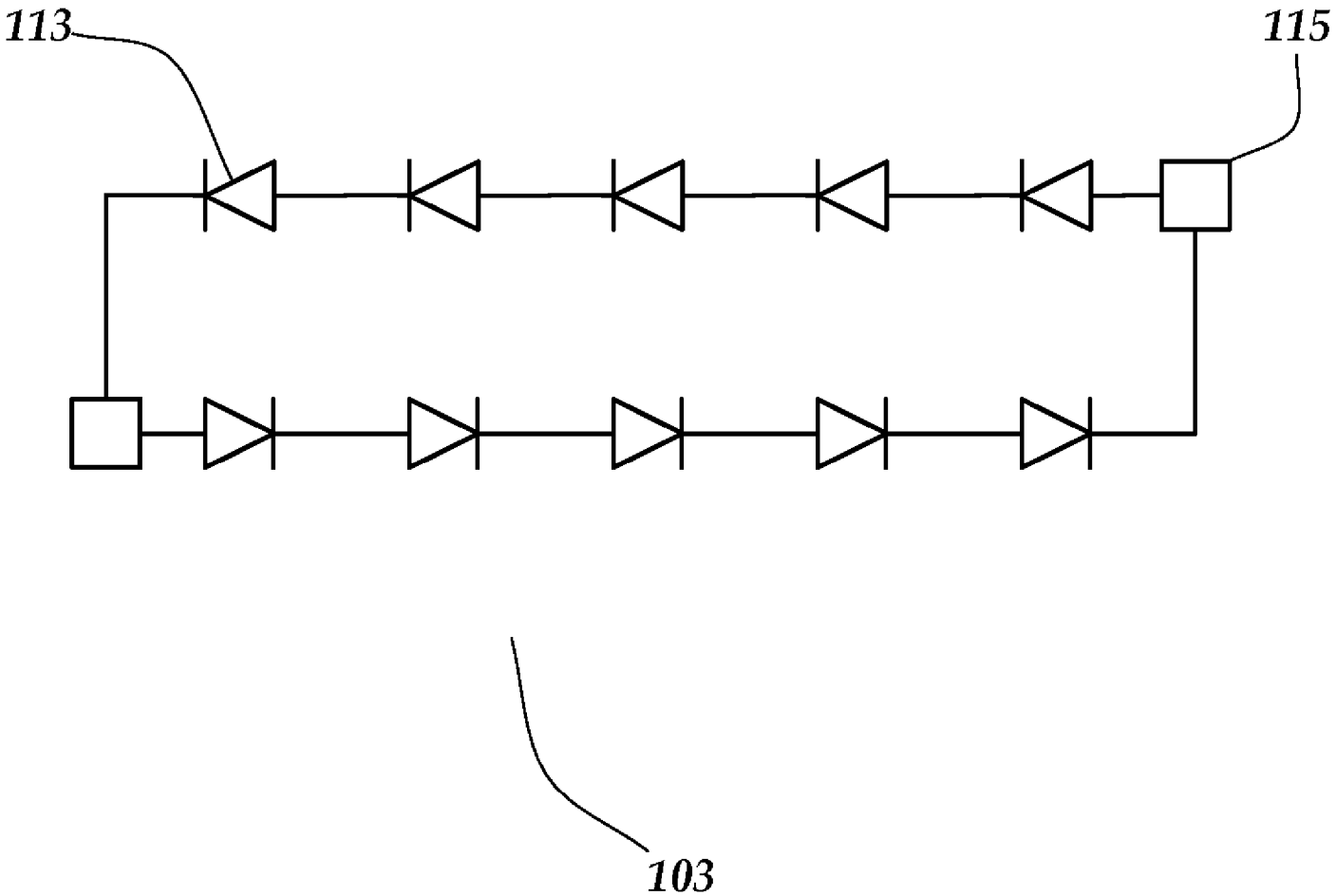
FIG. 2 is a circuit diagram showing one implementation of a bi-directional LED chip 103.

FIG. 2 shows a basic implementation of a bi-directional LED chip 103. Bi-directional LED chip 103 comprises two strands of LEDs 113 that are connected in series. The two strands of LEDs 113 are connected in parallel to electrodes 115. Because LEDs 113 are diodes, current flow is unidirectional. Thus, when an AC power source 105 is supplied to the electrodes 115 of bi-directional LED chip 113, the supplied current alternates between flowing through each strand of LEDs 113. That is, current only flows through one strand of LEDs 113 at a time due to the unidirectional property of LEDs 113. Of course, persons having ordinary skill in the art will recognize that the concept of a bi-directional LED chip 103 may be implemented in any number of ways with any number of LEDs 113; the circuit diagram provided in FIG. 2 is for illustrative purposes only and is not intended as a limitation to the invention described herein.

Figure 3B:
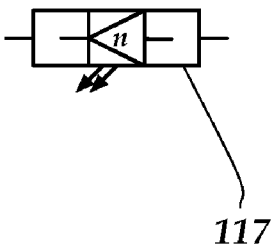
FIG. 3*b* is a block diagram symbol for multiple bi-directional LED chips 103 that are connected in parallel.
Figure 3A:
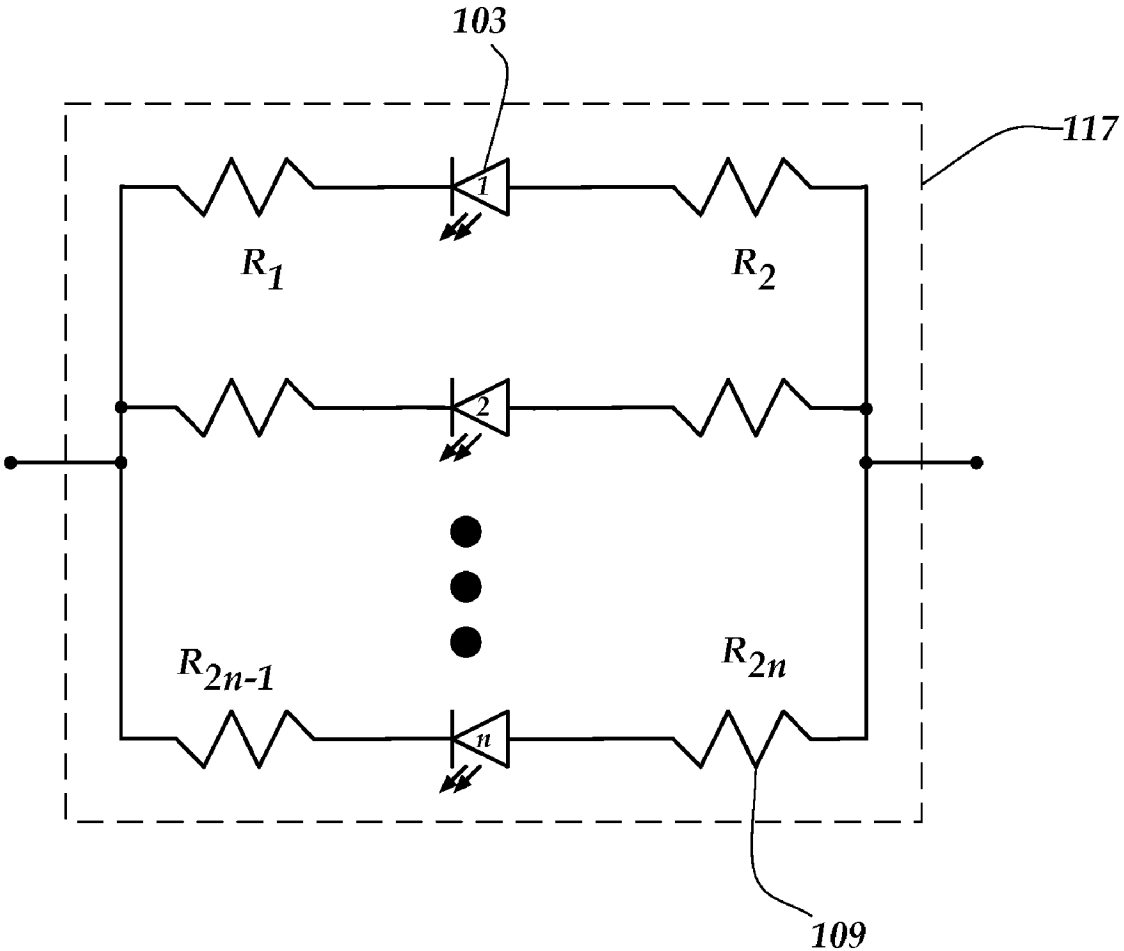
FIG. 3*a* is a circuit diagram showing the connection of multiple bi-directional LED chips 103 in parallel.

Turning now to FIG. 3*a* and 3*b*, multiple bi-directional LED chips 103 may be connected in parallel to provide AC-powered LED lamp 101 with additional light output. Resistors 109 ($R_1, R_2, \ldots R_{2n-1}, R_{2n}$) are required to be connected in series with each bi-directional LED chip 103 in order to provide equal voltage across all bi-directional LED chips 103; resistors 109 in series with bi-directional LED chips have equal resistances. Equal voltage across bi-directional LED chips 103 provides uniform color and lumen output for each bi-directional LED chip 103.

FIG. 3*b* shows the block diagram symbol for an n-LED block 117 in which n bi-directional LED chips 103 are connected in parallel. Depending on the light output desired, n may range from one (1) to ten (10) bi-directional LED chips 103 or even higher. As one example, an n-LED block 117 that uses four (4) bi-directional LED chips 103 draws 16 watts of power to provide a light output of 594 lumens. Such light output is virtually identical to the 595 lumen output of a 65-watt incandescent bulb, and the invention uses less than 25% of the power of a standard incandescent bulb.

Figure 4:
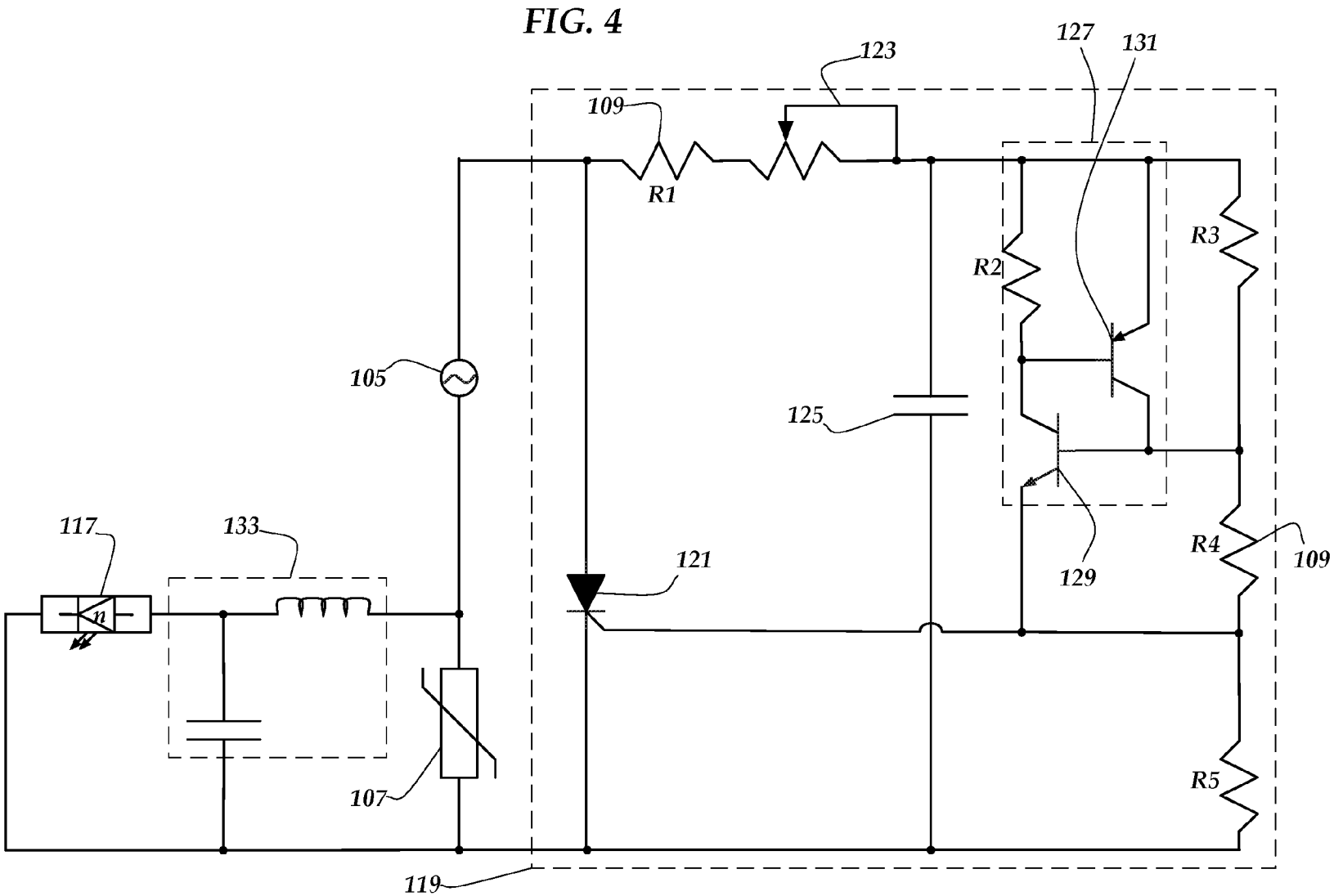
FIG. 4 is a circuit diagram showing an implementation of the invention having a power source, load, SCR dimmer, and surge protection.

As seen in FIG. 4, rheostat 111 may be replaced with a semiconductor-controlled rectifier ("SCR") dimmer 119. As compared to dimming provided by rheostat 111, SCR dimmer 119 provides dimming capability with reduced power usage. SCR dimmer 119 is connected in series with respect to n-LED block 117. SCR dimmer 119 comprises an SCR gate 121, a variable resistor 123, a capacitor 125, a Darlington transistor 127, and several resistors 109. Variable resistor 123 responds to human or automated input to provide a predetermined resistance capable of reducing current across n-LED block 117. Variable resistor 123 is connected in series to a resistor 109 (R1) in order to ensure that the circuit comprising SCR dimmer 119 maintains a finite resistance. Variable resistor 123 operates to control the voltage at which capacitor 125 charges. When capacitor 125 charges, Darlington transistor 127 activates and triggers SCR gate 121. Darlington transistor 127 is comprised of NPN transistor 129, PNP transistor 131, and resistor 109 (R2). The voltage level at which SCR gate 121 triggers is controlled by resistors 109 (R3-R5). Once SCR gate 121 is triggered, LED lamp 101 illuminates.

Figure 5B:
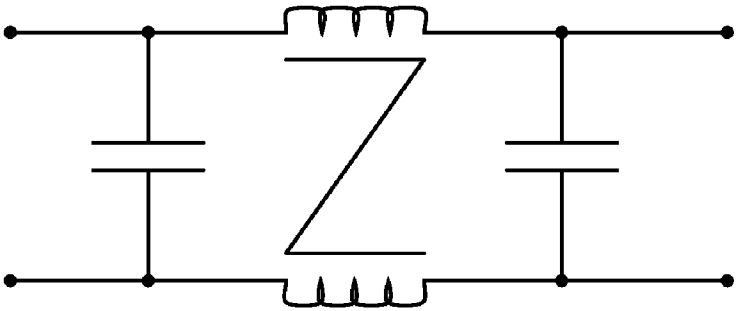
FIG. 5*b* is another method of implementing an LC filter into the invention.
Figure 5A:
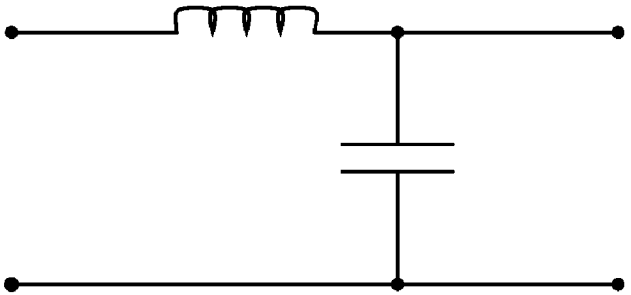
FIG. 5*a* is one method of implementing an LC filter into the invention.

Another component of LED lamp 101 is an LC filter 133, which provides reduced harmonics and flickers caused by conduction of n-LED block 117 and by changes to the conduction phase angles generated by the SCR dimmer 119. LC filter 133 also increases the duration the voltage applied across bi-directional LED chip 103 remains above the threshold level required to illuminate bi-directional LED chip 103. Various methods of implementing LC filter 133 are shown in FIGS. 5*a* and 5*b*.

The inventors have provided examples of the invention in use with various dimming devices known in the prior art, including a rheostat and an SCR dimmer. Persons having ordinary skill in the art will recognize that other dimmers, such as TRIACs, may be substituted for the dimmers disclosed herein. The inventors intend to claim all such substitutions as may fall within the scope of the invention.

Figure 6:
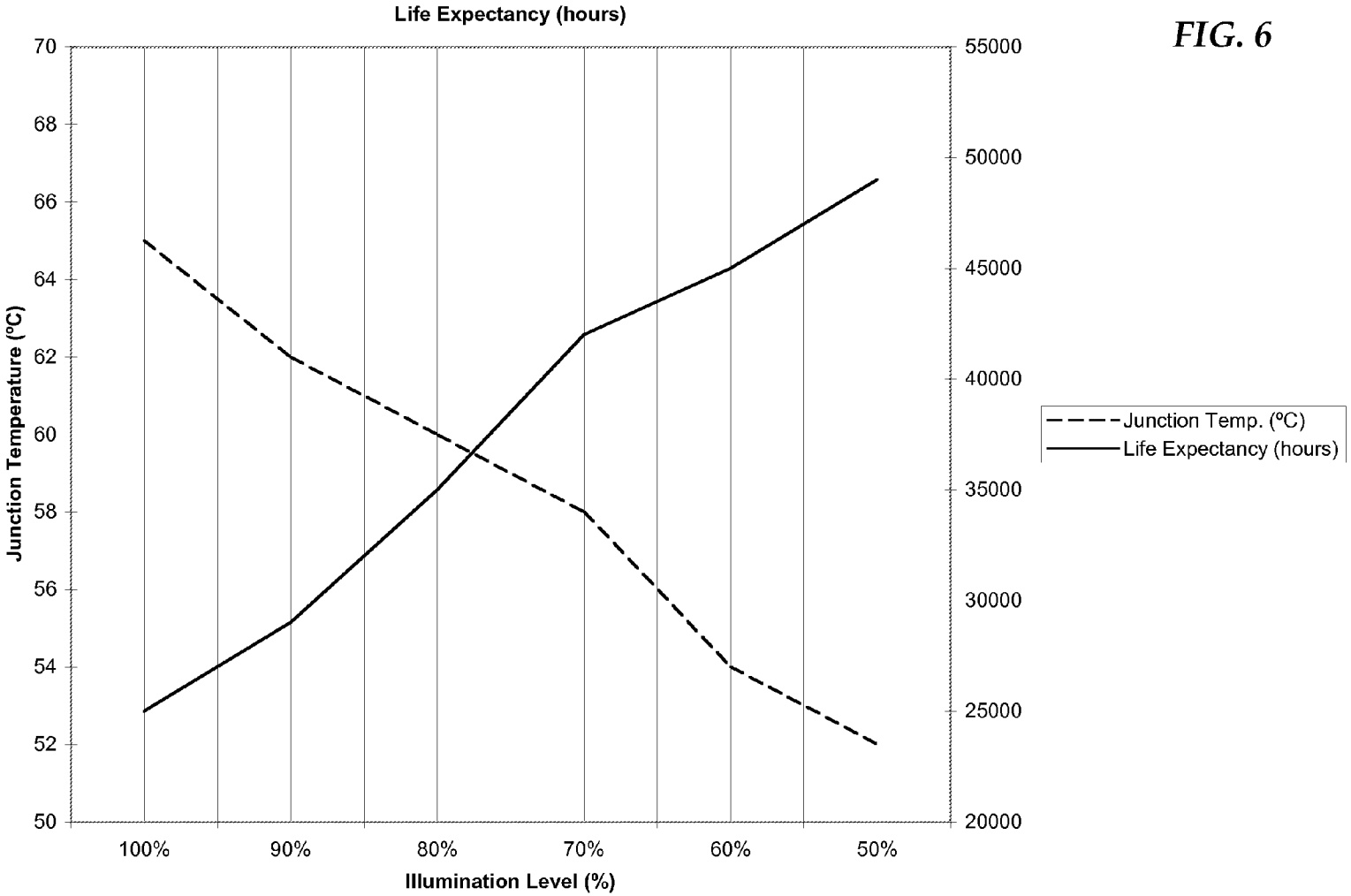
FIG. 6 is a chart showing the decreased junction temperature and increased life expectancy realized by the invention.

Turning now to FIG. 6, the benefits of using dimmable LED lamp 101 include lower junction temperature in each LED 113 that comprises bi-directional LED chip 103. Lower junction temperature translates into longer life for bi-directional LED chip 103. The following table presents the data points shown in FIG. 6:

| Illumination Level (%) | Junction Temp. (° C.) | Life Expectancy (hours) |
|---|---|---|
| 100% | 65 | 25000 |
| 90% | 62 | 29000 |
| 80% | 60 | 35000 |
| 70% | 58 | 42000 |
| 60% | 54 | 45000 |
| 50% | 52 | 49000 |

Figure 7:
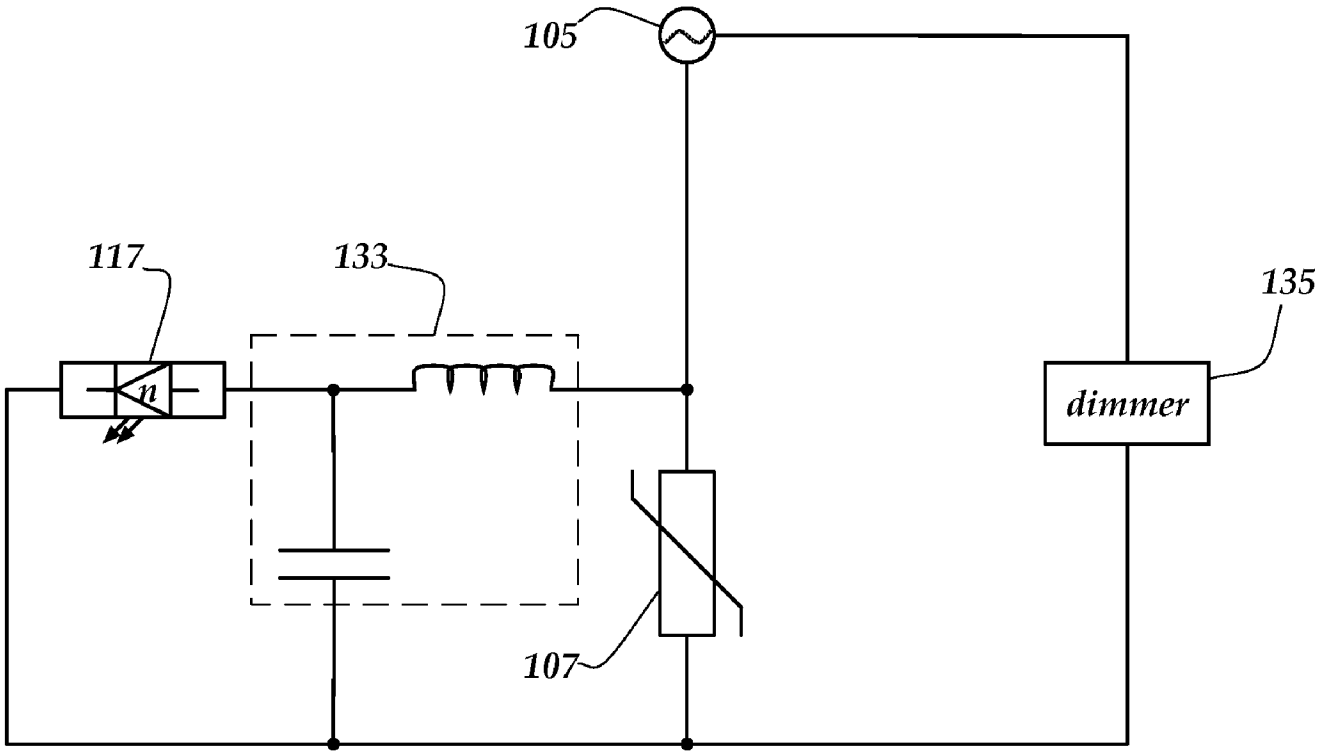
FIG. 7 is a circuit diagram showing the preferred arrangement of the invention.

The preceding disclosure discusses the various necessary and optional components of the invention, which the inventors have used to create several preferred embodiments. The general circuit diagram for each of the preferred embodiments is shown in FIG. 7. In the first preferred embodiment, AC power source 105 has a voltage of 120 VAC. Resistors 109 used in n-LED block 117 have a resistance of 470Ω. N-LED block 117 has 3 bi-directional LED chips 103 drawing 2 W, giving LED lamp 101 a power draw of 6 W. Varistor 111 has a maximum resistance of 50 kΩ. Varistor 107 is a metal oxide varistor having an operating voltage range of 200V to 460V RMS. LC filter 133 has a capacitance of 0.1 to 2.2 μF and an inductance of 1-5 mH. The first preferred embodiment utilizes a dimmer 135, which may be a rheostat 111, an SCR dimmer 119, or other dimming device.

The difference between the first preferred embodiment and the remaining three preferred embodiments deals with the number of LEDs 113 in n-LED block 117 and the values for voltage, resistance, capacitance, inductance, and power for the elements of the circuit comprising LED lamp 101. The table below summarizes the preferred embodiments:

| Element | Pref. Emb. 1 | Pref. Emb. 2 | Pref. Emb. 3 | Pref. Emb. 4 | Pref. Emb. 5 |
|---|---|---|---|---|---|
| $V_{source}$ (VAC) | 120 | 120 | 120 | 12 | 120 |
| n | 3 | 5 | 4 | 1 | 1 |
| $R_n$ (Ω) | 470 | 470 | 470 | 470 | 470 |
| W (per chip) | 2 | 2 | 4 | 3 | 4 |
| W (total) | 6 | 10 | 16 | 3 | 4 |
| $V_{RMS}$ (VAC) | 4-460 | 4-460 | 4-460 | 4-460 | 4-460 |
| C (μF) | 0.1 | 0.1 | 0.1 | 0.1 | 0.1 |
| L (mH) | 1 | 1 | 1 | 1 | 1 |

While the inventors have described above what they believe to be the preferred embodiments of the invention, persons having ordinary skill in the art will recognize that other and additional changes may be made in conformance with the spirit of the invention and the inventors intend to claim all such changes as may fall within the scope of the invention.

We claim:

1. An LED lamp, comprising:

an AC power source;

a varistor connected in series with the AC power source for regulating voltage spikes;

one or more bi-directional LED chips having a threshold on voltage connected in parallel, wherein the bi-directional LED chips are connected in series to the AC power source and in parallel to the varistor;

two or more resistors connected in series to each side of each bi-directional LED chip for regulating the voltage across the bi-directional chip;

one or more filters for reducing voltage spikes and harmonics and for increasing the duration during which the voltage applied across the bi-directional LED chip remains above the threshold on voltage required to illuminate bi-directional LED chip; and a dimmer for changing the voltage applied across the bi-directional chips.

2. The LED lamp of claim 1, wherein the dimmer is a rheostat.

3. The LED lamp of claim 1, wherein the dimmer is an SCR dimmer.

4. The LED lamp of claim 1, wherein the dimmer is a TRIAC dimmer.

* * * * *